US006260661B1

(12) United States Patent
Cutter et al.

(10) Patent No.: US 6,260,661 B1
(45) Date of Patent: Jul. 17, 2001

(54) SAFETY LINE MOUNTING METHODS AND APPARATUS

(75) Inventors: Weston L. Cutter, Mendota Heights, MN (US); Patrick J. Novak, North Liberty, IA (US)

(73) Assignee: Capital Safety Inc., Red Wing, MN (US)

( * ) Notice: Subject to any disclaimer, the term of this patent is extended or adjusted under 35 U.S.C. 154(b) by 0 days.

(21) Appl. No.: 09/580,941

(22) Filed: May 30, 2000

Related U.S. Application Data

(63) Continuation of application No. 09/672,377, filed on May 3, 1999, which is a continuation-in-part of application No. 09/177,410, filed on Oct. 23, 1998, now Pat. No. 6,056,085.

(51) Int. Cl.[7] ..... A62B 35/00
(52) U.S. Cl. ..... 182/45; 182/36
(58) Field of Search ..... 182/36, 45, 3

(56) References Cited

U.S. PATENT DOCUMENTS

| | | | |
|---|---|---|---|
| 3,675,283 | 7/1972 | Gregorovic | 24/73 SA |
| 4,265,179 | 5/1981 | Tupper | 104/182 |
| 4,584,945 | 4/1986 | Tupper | 104/182 |
| 4,790,410 | 12/1988 | Sharp | 182/36 |
| 4,905,606 | 3/1990 | Tupper | 104/113 |
| 5,002,152 | 3/1991 | Lebow | 182/3 |
| 5,127,338 | 7/1992 | Flux | 105/151 |
| 5,279,385 | 1/1994 | Riches | 182/3 |
| 5,282,597 * | 2/1994 | Babcock | 182/45 |
| 5,297,651 | 3/1994 | Vandelinde | 182/3 |
| 5,343,975 | 9/1994 | Riches | 182/3 |
| 5,595,260 * | 1/1997 | Jalla | 182/3 |
| 5,758,743 * | 6/1998 | Coyle | 182/45 |
| 5,829,203 * | 11/1998 | Ealer | 182/45 |

* cited by examiner

*Primary Examiner*—Alvin Chin-Shue
(74) *Attorney, Agent, or Firm*—Mau & Krull, P.A.

(57) ABSTRACT

A first roof mounting assembly includes first and second brackets which are disposed on top of a roof and fastened to adjacent beams which support the roof. First and second brackets are mounted to respective brackets and interconnected together with an anchorage. A second roof mounting assembly includes first and second brackets having base members and intermediate members. The base members are connected to the roof beams, and the intermediate members are interconnected by a cross-member which supports the anchorage. In a preferred application, the anchorage accommodates passage of a slotted coupling device movably mounted on the safety line, and the safety line may be secured to the anchorage without obtaining access to either end of the line.

20 Claims, 10 Drawing Sheets

SAFETY LINE MOUNTING METHODS AND APPARATUS

This application is a continuation of U.S. patent application Ser. No. 09/672,377, which was filed on May 3, 1999 and a CIP of Ser. No. 09/177,410 filed on Oct. 23, 1998, now U.S. Pat. No. 6,056,085.

FIELD OF THE INVENTION

The present invention relates to methods and apparatus for anchoring a safety line relative to a roof.

BACKGROUND OF THE INVENTION

Those skilled in the art recognize the need to anchor objects and/or people relative to a support structure. For example, when work is being performed on a building, a worker is well advised to attach a safety line or fall arrest line between his body and a structurally sound portion of the building. One widely accepted fall arrest system uses intermittent brackets to support a horizontal line which in turn, supports individual worker safety lines and minimally interferes with the worker's movements. A slotted coupling device is connected to an individual safety line and movably mounted on the horizontal line. The device is designed to traverse the brackets without compromising the structural integrity of the connection between the worker and the support structure. Examples of such systems are disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al.

The foregoing prior art patents disclose horizontal safety line systems which are advantageous in many respects. However, one shortcoming of such systems is that the safety line must be threaded through each of the anchorages or support brackets. As a result, if one of the brackets requires replacement, then an end of the safety line must be freed, pulled through any intervening brackets, and then threaded through the replacement bracket and back through the intervening brackets. Such a procedure is time consuming and increases the likelihood of undesirable wear and tear on other components of the system. Therefore, a need remains for an intermediate anchorage or bracket which is relatively simple to make and use, may be connected to an intermediate portion of a safety line, and does not compromise the structural integrity of the system.

Various methods and apparatus are currently used to secure safety lines to roofs, whether for purposes of supporting slotted coupling devices or otherwise. In one relatively common application scenario, beams, also known as pearlings, span opposing walls of a structure and are disposed several feet apart from one another. Panels, which are typically corrugated metal, are mounted on top of the beams, in overlapping fashion, to form a roof over the structure. Problems can arise when any sort of safety line is anchored relative to the panels, without regard to the locations of the beams. For example, the fall of a person connected to the safety line can significantly damage the panels to which the line is anchored. Also, the provision of holes through the panels increases the chances of leaks in the roof. In other words, a need remains for an anchorage or mounting bracket which is simple to make and use, and which does not compromise the structural integrity of the roof or the safety system.

SUMMARY OF THE INVENTION

The present invention provides a mounting system designed to be mounted on a roof to support a safety line for fall arrest purposes. A first embodiment of the invention includes first and second base members which span adjacent roof beams and are fastened thereto. First and second brackets have base portions which are fastened to respective base members, and distal portions which are fastened to a common safety line anchorage. Both the distance between the base members and the positions of the brackets relative thereto are adjustable.

A second embodiment of the present invention includes first and second brackets having respective, opposite end, base members which are secured to adjacent roof beams, and respective intermediate members which overlap one another. A cross-member is secured between the overlapping intermediate members of the first bracket and the overlapping intermediate members of the second bracket, and a safety line anchorage is mounted on an intermediate portion of the cross-member. Both the distance between the base members and the lengths of the brackets are adjustable.

On either of the foregoing embodiments, the anchorage is preferably connected to an intermediate portion of the safety line, and accommodates passage of a slotted coupling device movably mounted on the safety line. Also, the brackets are designed to deform and thereby absorb energy in the event of a fall. Many features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
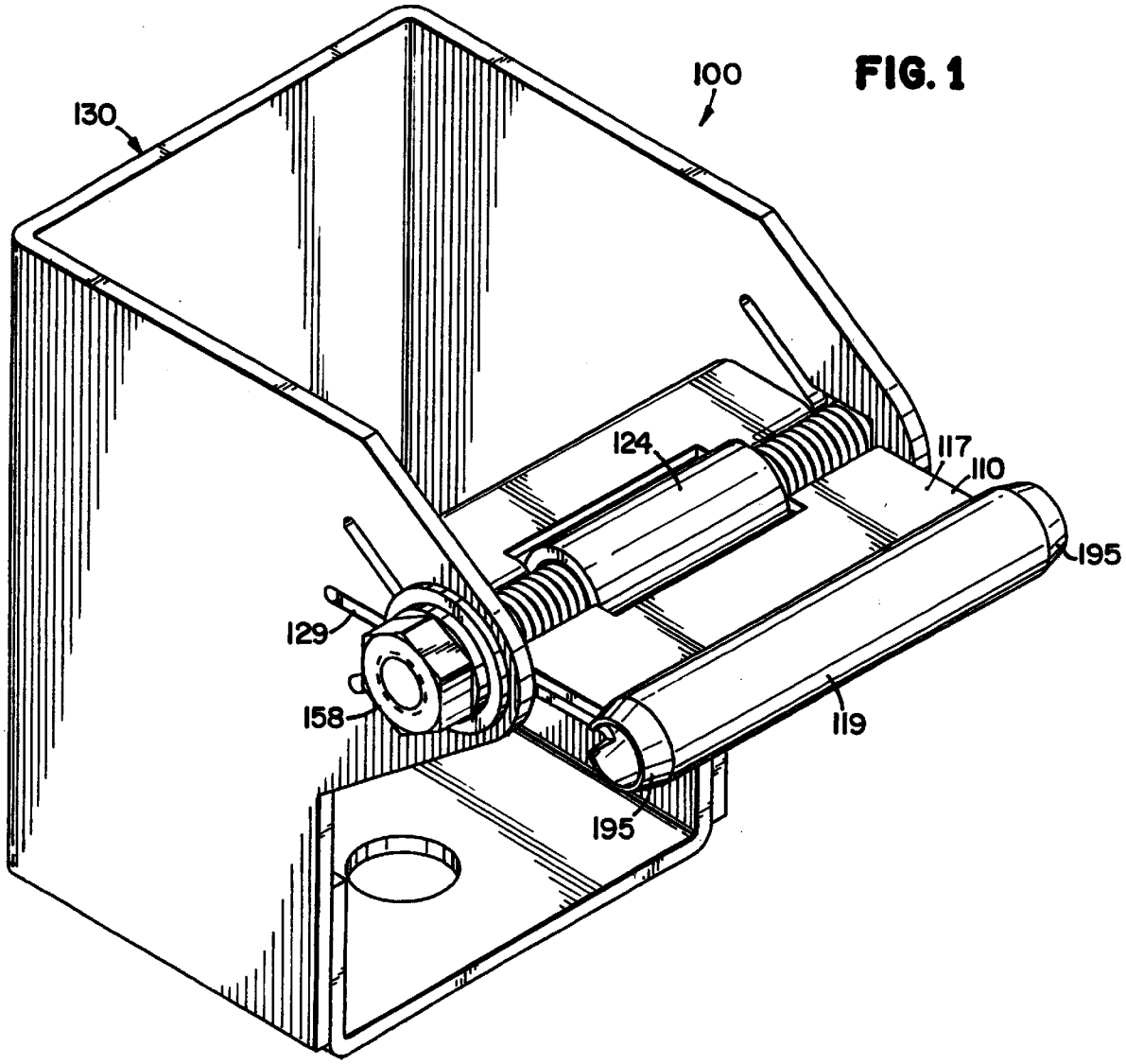
FIG. 1 is a perspective view of an anchorage constructed according to the principles of the present invention.
Figure 2:
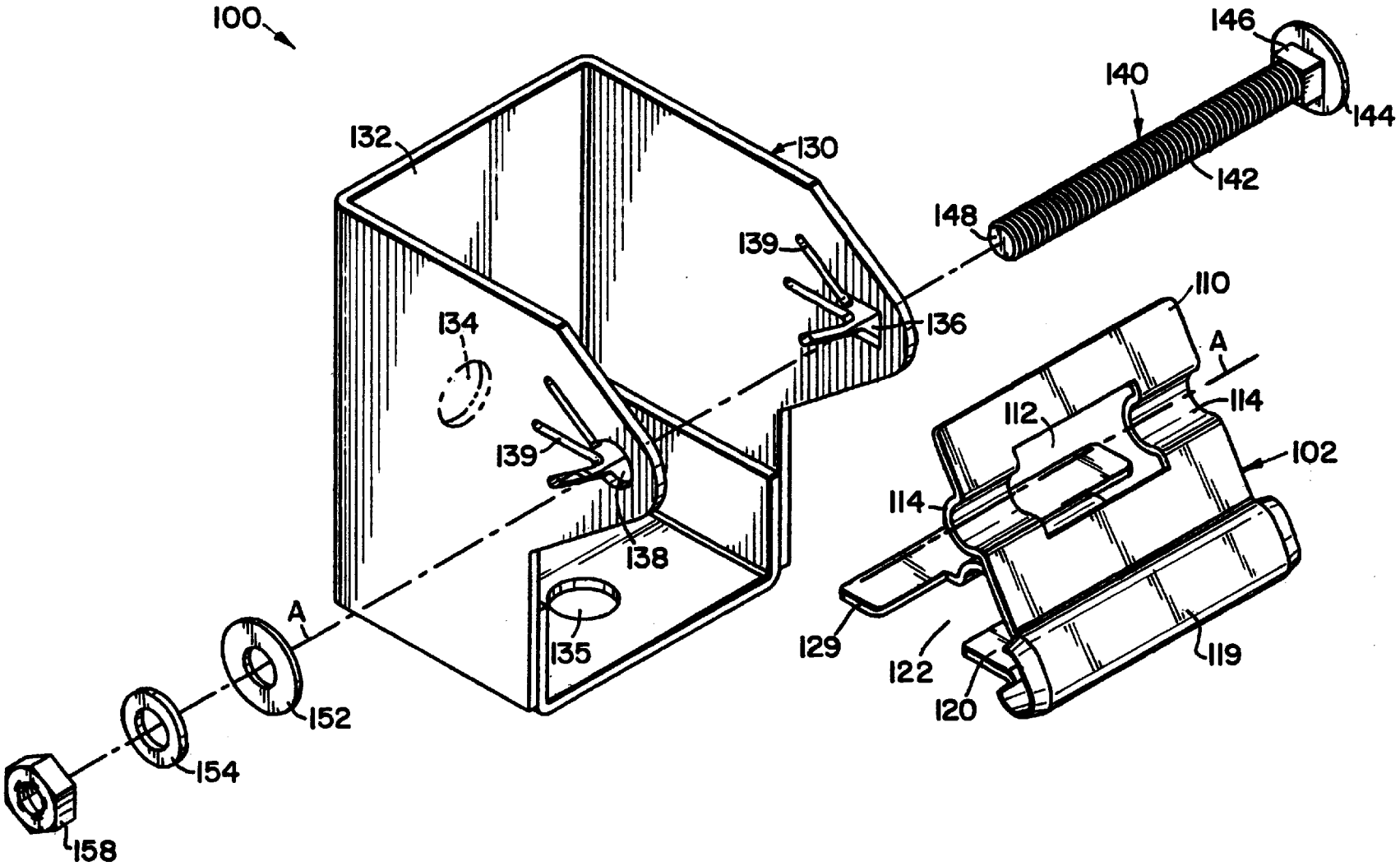
FIG. 2 is an exploded perspective view of the components of the anchorage shown in FIG. 1.
Figure 5:
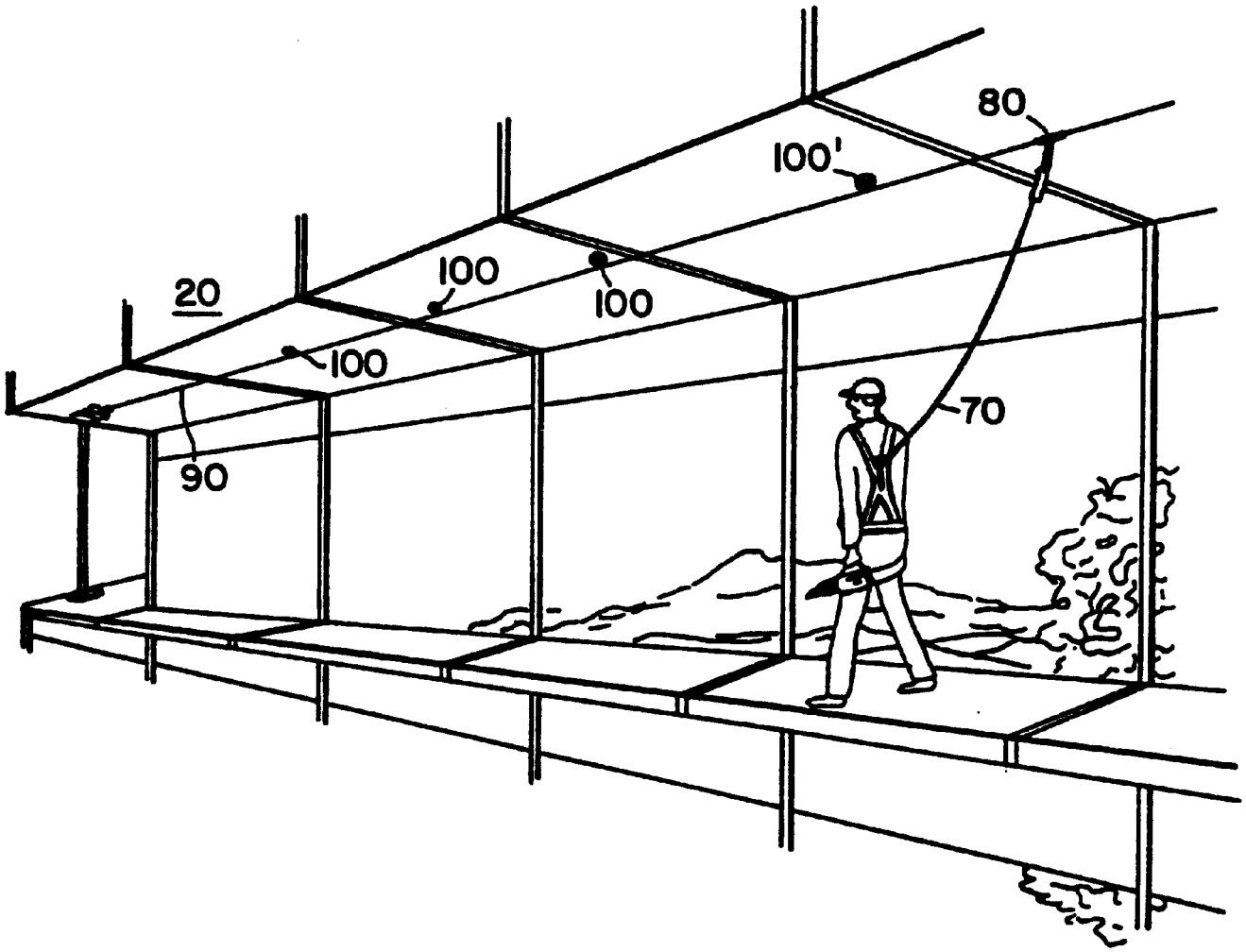
FIG. 5 is a perspective view of a horizontal safety line system including several units of the anchorage shown in FIG. 1.

A preferred embodiment anchor assembly constructed according to the principles of the present invention is designated as 100 in FIGS. 1–2 and 5. The assembly 100 generally includes a safety line support 102, a bracket 130, and a bolt 140 connected to the bracket 130 and the support 102. The assembly 100 is suitable for use as a component in horizontal safety line systems like those disclosed in U.S.

Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al., all of which are incorporated herein by reference.

The support 102 may be described in terms of a first plate 110 and a second plate 120 which are integral portions of a single member. The support 102 is preferably made of steel and provided in the configuration shown in FIG. 2. A cylindrical tube 119 is defined at the integrally joined ends of the plates 110 and 120. The tube 119 is sized and configured to fit snugly over a safety line and to accommodate passage of a slotted coupling member. Opposite ends 195 of the tube 119 are tapered to facilitate alignment of the coupling member with the tube 119.

The lower plate 120 (as viewed in FIGS. 1–2) has a distal end opposite the cylinder 119. This opposite end of the plate 120 is provided with tabs 129 which extend in opposite directions from one another and parallel to the longitudinal axis of the tube 119 (and the safety line). When the support member 102 is configured as shown in FIG. 2, the tabs 129 may be maneuvered into any of the opposing pairs of slots 139 defined in the bracket 130, as will be further discussed below.

The upper plate 110 also has a distal end opposite the cylinder 119. This opposite end of the plate 110 is maneuvered into proximity to the other plate 120 (and its distal end) by rotating the plates 110 and 120 toward one another. This rotating step must overcome resistance to bending of the material defining the cylindrical tube 119 and effectively closes the tube 119 about the safety line. When the support member 102 is configured as shown in FIG. 1, the tabs 129 are effectively retained by the bracket 130 (even before insertion of the bolt 140).

An intermediate portion of the upper plate 110 has channel defining portions 114 disposed on opposite sides of an opening 112. The portions 114 have a semi-cylindrical profile centered about an axis designated as A in FIG. 2. An intermediate portion of the lower plate 120 has a notch 122 in each side to accommodate a respective portion 114 of the upper plate 110. The intermediate portion of the lower plate 120 also has a channel defining portion 124 which protrudes through the opening 112 in the upper plate 110. The portion 124 has a semi-cylindrical profile which is also centered about the axis A, and which is complementary to the profile of the portions 114 on the upper plate 110. In other words, when the plates 110 and 120 are disposed as shown in FIG. 1, the interwoven portions 114 and 124 cooperate to define a passage bounded by cylindrical sidewalls.

The bolt 140 has a shaft 142 which extends from a head 144 to a distal end 148. The portion of the shaft 142 nearest the head 144 has a square profile designated at 146 in FIG. 2. The remainder of the shaft 142 has a circular profile and is provided with helical threads. With the tabs 129 occupying the desired slots 139, the distal end 148 of the bolt 140 is inserted through a square hole 136 in a first sidewall of the bracket 130, then through the interwoven portions 114 and 124, and then through the round hole 138 in an opposite sidewall of the bracket 130. A flat washer 152 and a spring washer 154 are moved onto the distal end 148, followed by a threaded nut 158. Among other things, a lock nut may be substituted for the nut 158 and the spring washer 154. During tightening of the nut 158, the bolt 140 is manipulated so that the squared portion 146 of the shaft 142 inserts into the square hole 136 in the sidewall of the bracket 130. When assembled as shown in FIG. 1, the support 102 may be described in terms of a neck portion 117 and a head portion 119 which are sized and configured to support a safety line while accommodating passage of a slotted coupling member along the safety line. The aforementioned sidewalls of the bracket 130 extend parallel to one another and perpendicular to the axis A. The slots 139 in each sidewall intersect the axis A, and adjacent slots 139 define an angle of thirty degrees therebetween. Hence, if the orientation of the bracket 130 in FIG. 2 is considered upright, then the support 102 may be secured to the bracket 130 in such a manner that the neck portion 117 extends horizontally or thirty degrees in either direction from horizontal.

The bracket 130 has an end wall which extends perpendicular to the sidewalls and the middle slots 139, and a base wall which extends perpendicular to both the end wall and the sidewalls. A respective hole 134 or 135 extends through a central portion of each of these two walls to facilitate connection of the bracket 130 to a support structure (by means of a bolt, for example). The net effect of the alternative mounting holes 134 and 135 and the alternative slots 139 is that neck portion 117 of the support 102 may always be disposed at an angle within fifteen degrees of an optimal orientation regardless of installation constraints.

FIG. 5 shows a plurality of anchorages 100 mounted to an overhead (from the perspective of the depicted worker) portion of a support structure 20. The anchorages 100 support a horizontal safety line 90, and the worker's individual safety line 70 is connected to the horizontal safety line 90 by means of a slotted coupling member 80. As noted above, if the anchorage designated as 100' were damaged to the exclusion of the other anchorages 100, then the damaged anchorage 100' could simply be removed and replaced without disconnecting the line 90 from the other anchorages 100 and subsequently reconnecting the line 90 to the other anchorages 100.

Figure 3:
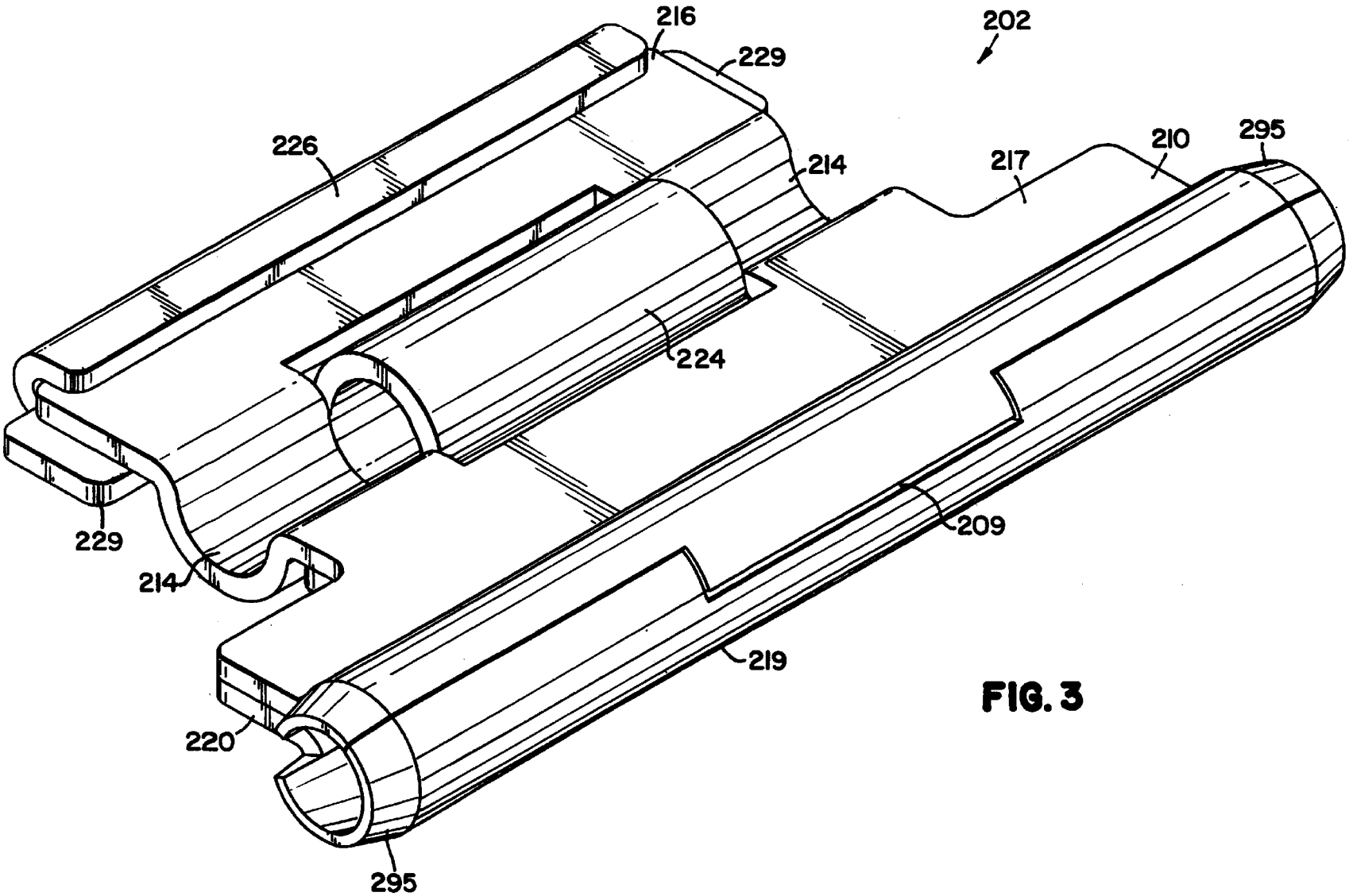
FIG. 3 is a perspective view of an alternative component suitable for use on the anchorage shown in FIG. 1.

The foregoing description is made with reference to only one, preferred embodiment of the present invention. Those skilled in the art will recognize various modifications may be made to the preferred embodiment 100 without departing from the scope of the present invention. For example, an alternative support portion of the present invention is designated as 202 in FIG. 3. The support 202 is suitable for use together with the bracket 130 and bolt 140 shown in and described with reference to FIGS. 1–2. However, this embodiment 202 did not test as well as the preferred embodiment support 102.

The support 202 includes first and second plates 210 and 220 having first ends which cooperate to define a cylindrical tube 219, and intermediate portions which cooperate to define a neck portion 217 extending between the tube 219 and the bracket 130. Contrary to the preferred embodiment support 102, the plates 210 and 220 are separate pieces (which cooperate to define a seam designated as 209 in FIG. 3). At an end of the support 202 opposite the seam 209, a distal end 226 of the lower plate 220 folds over a distal end 216 of the upper plate 210. Like on the preferred embodiment support 102, the ends 295 of the tube 219 are tapered to facilitate alignment of slotted coupling members relative thereto. Also, similar channel defining portions 214 and 224 and corresponding notches are provided on respective plates 210 and 220 to receive the bolt 140. As on the preferred embodiment support 102, tabs 229 extend in opposite directions from the lower plate 220 and insert into respective slots 139 in the bracket 130.

Figure 4:
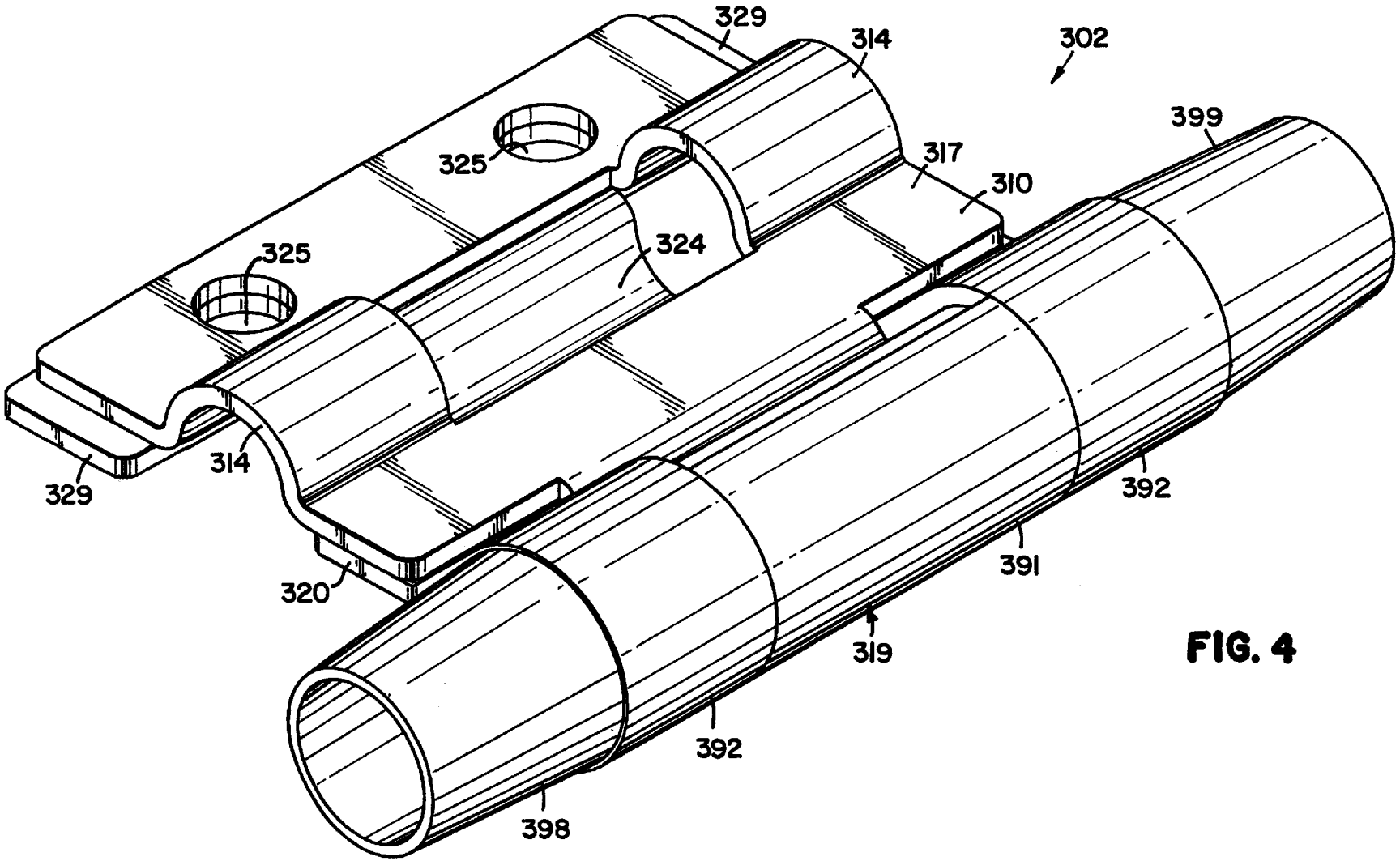
FIG. 4 is a perspective view of another alternative component suitable for use on the anchorage shown in FIG. 1.

Another alternative support portion is designated as 302 in FIG. 4. The support 302 is likewise suitable for use together with the bracket 130 and bolt 140 shown in and described with reference to FIGS. 1–2. However, this embodiment 202 also did not test as well as the preferred embodiment support 102.

The support 302 includes first and second plates 310 and 320 having first ends 391 and 392 which cooperate to define a cylindrical tube 319, and intermediate portions which cooperate to define a neck portion 317 extending between the tube 319 and the bracket 130. As on the support 202, the plates 310 and 320 are separate pieces. The first end 391 of the first plate 310 defines about three-fourths of a cylinder and protrudes through a central opening in the second plate 320. The first end of the second plate 320 has opposite portions 392 which define about three-fourths of cylinders and protrude through respective opposite side notches in the first plate 310. The interwoven cylindrical portions 391 and 392 align and cooperate to define the tube 319. Bifurcated halves 398 and 399 of a nylon bushing are disposed about the horizontal safety line and within the tube 319. The ends of the bushing are tapered to facilitate alignment of slotted coupling members relative thereto.

At an end of the support 302 opposite the tube 319, distal ends of the plates 310 and 320 overlap and are bolted together via aligned holes 325. As on the other supports 102 and 202, tabs 329 extend in opposite directions from the lower plate 320 and insert into respective slots 139 in the bracket 130. Also, channel defining portions 314 and 324 are provided on respective plates 310 and 320 to receive the bolt 140. The open areas in the intermediate portions of the plates 310 and 320 are not necessary on this embodiment 302, because the portions 314 and 324 are not intersected by a plane defined between the two plates 310 and 320.

Although the present invention has been described with reference to specific embodiments and particular applications, those skilled in the art will recognize other embodiments and/or applications. Moreover, although specifically designed for use relative to an intermediate portion of a horizontal safety line, the present invention is nonetheless suitable for use with a safety line having exposed ends. Also, as compared to prior art anchorages, and in particular, the bracket disclosed in U.S. Pat. No. 5,343,975 to Riches et al., the construction of the preferred embodiment anchorage 100 enables it to absorb approximately twice as much energy when subjected to forces associated with the arrest of a person's fall. In view of the foregoing, a person skilled in the art may be inclined to make an intermediate bracket which is structurally comparable to the preferred embodiment anchorage 100 but cannot be secured to the intermediate portion of a safety line. In this regard, the present invention may be seen to provide an anchorage having at least one plate 110, 120 extending between a first end and a second end. The first end supports a tube 119 sized and configured to support a safety line inside the tube and to accommodate passage of a slotted coupling member outside the tube. The second end has tabs 129 which extend in opposite directions into slots 139 formed in opposing sidewalls of a bracket 130. A bolt 140 extends through holes in opposite sidewalls of the bracket 130 and through a channel on the at least one plate 110, 120. The resulting anchorage 100 is sized and configured to absorb energy in excess of known prior art devices.

A person skilled in the art may also be inclined to make an intermediate bracket which provides the versatility of the preferred embodiment anchorage 100 but cannot be secured to the intermediate portion of a safety line. In this regard, the present invention may be seen to provide an anchorage having at least one plate 110, 120 extending between a first end and a second end. The first end supports a tube 119 sized and configured to support a safety line inside the tube and to accommodate passage of a slotted coupling member outside the tube. The second end has tabs 129 which extend in opposite directions into any of several pairs of slots 139 formed in opposing sidewalls of a bracket 130. A bolt 140 extends through holes in opposite sidewalls of the bracket 130 and through a channel on the at least one plate 110, 120. The bracket 130 has an end wall which extends perpendicular to the sidewalls and the middle slots 139, and a base wall which extends perpendicular to both the end wall and the sidewalls. A respective hole 134 or 135 extends through a central portion of each of these two walls to facilitate connection of the bracket 130 to a support structure. The resulting anchorage 100 is adapted to accommodate a wider variety of installation scenarios than any known prior art device.

Figure 6:
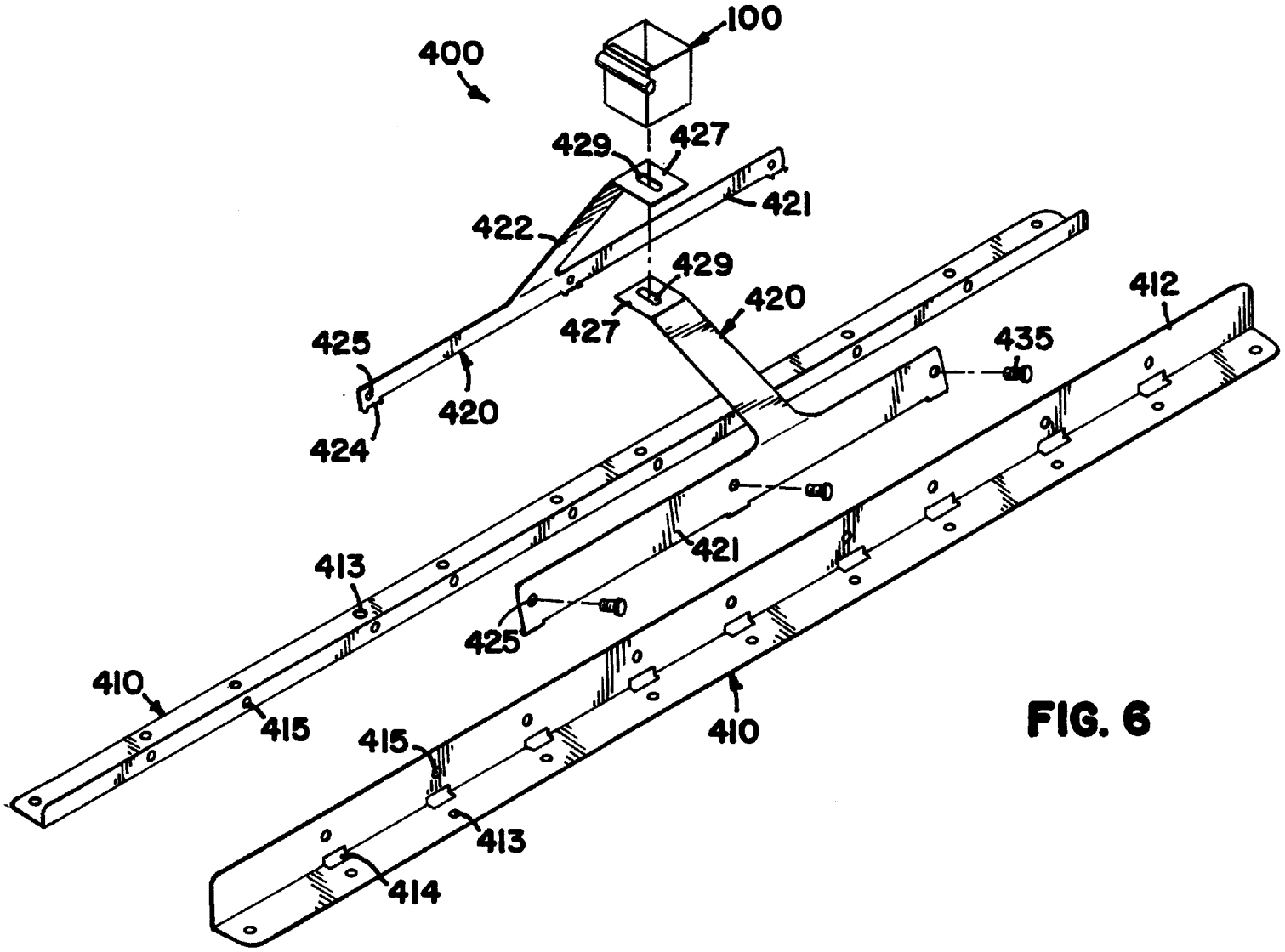
FIG. 6 is an exploded perspective view of a roof mounting assembly constructed according to the principles of the present invention.
Figure 7:
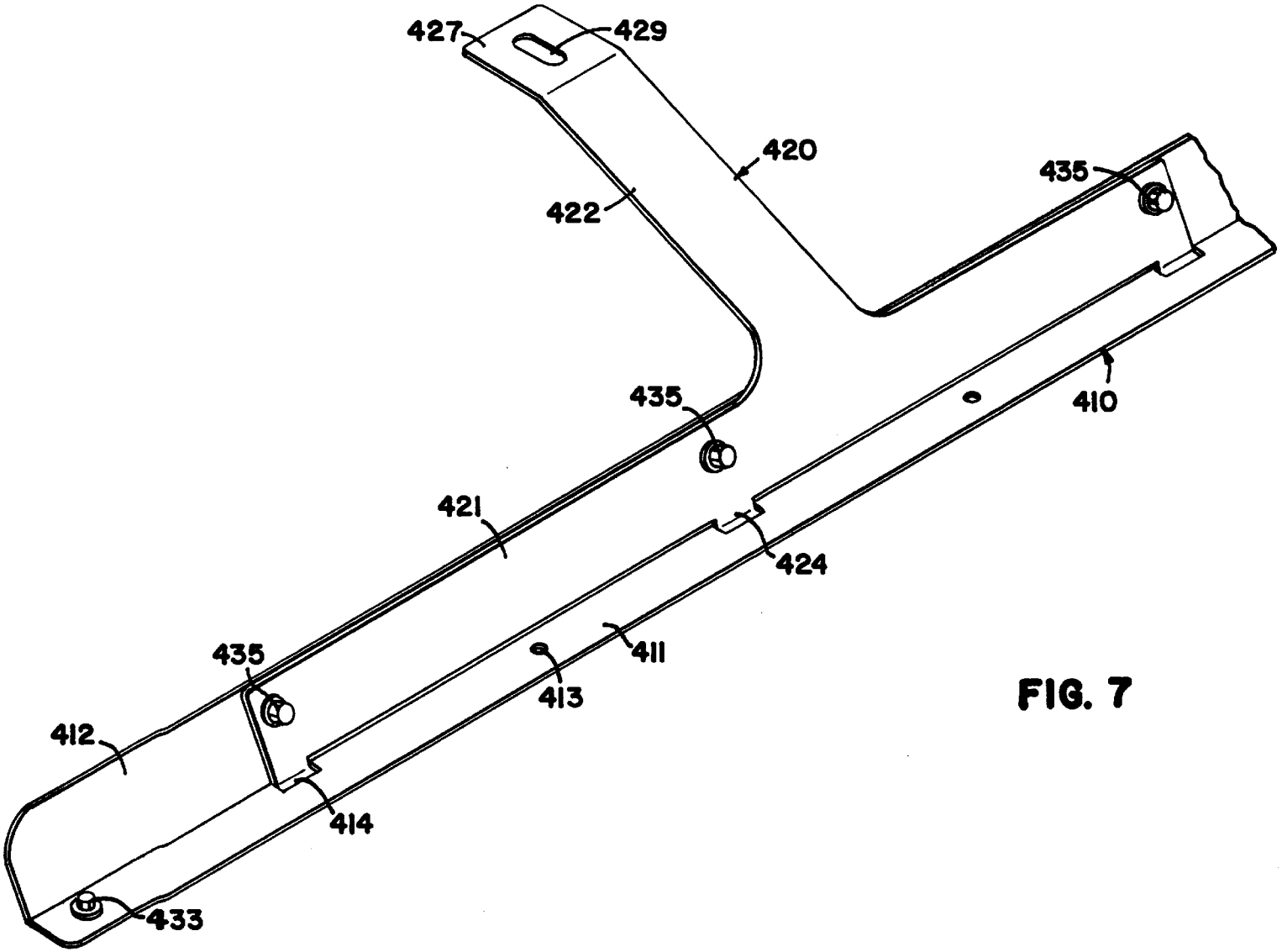
FIG. 7 is an enlarged perspective view of a portion of the assembly of FIG. 6.
Figure 8:
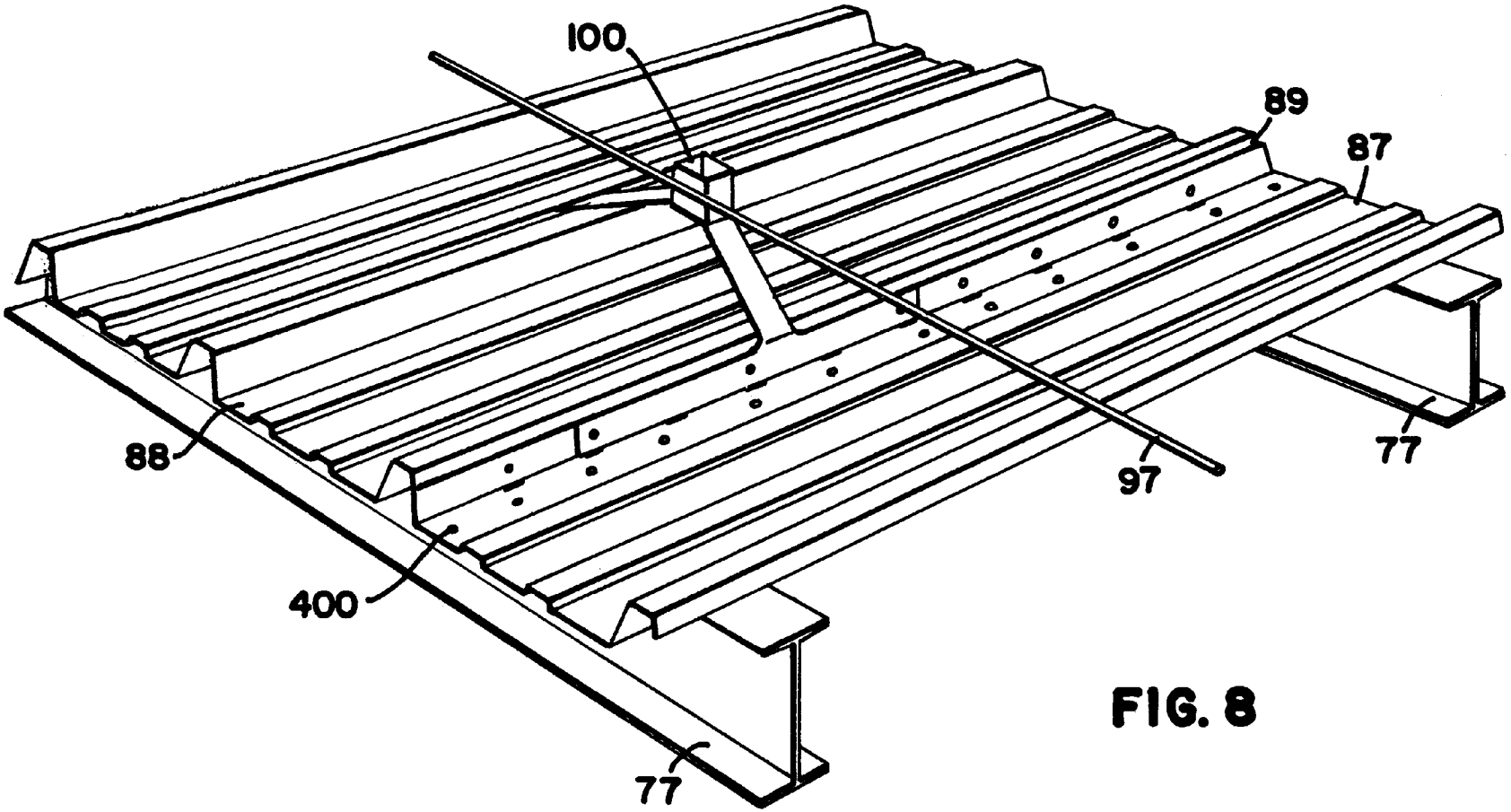
FIG. 8 is a perspective view of the assembly of FIG. 6 mounted on a roof and supporting a safety line.

FIGS. 6–8 show a mounting assembly 400 for interconnection between a roof and a safety line anchor, including but not limited to the preferred embodiment anchorage 100, for example. The assembly 400 is disposed on top of roof panels 87 and fastened to underlying beams or pearlings 77. The panels 87 are corrugated and/or have peaks bounded by sidewalls 89, and troughs 88 disposed between the peaks. The panels 87 are one of many different types, and there is no uniform standard for the distance between peaks or troughs, or the relatively heights or depths of same. The beams 77 typically have an I-shaped or Z-shaped profile and span opposing walls of the underlying building. The beams 77 extend parallel to one another and are spaced several feet apart from one another, but the spacing is not necessarily consistent.

The mounting assembly 400 generally includes first and second base members 410, first and second brackets 420, and associated fasteners 433 and 435. Each of the base members 410 is an elongate member having a generally L-shaped profile. In this regard, each of the base members 410 includes a first elongate strip 411 and a second elongate strip 412 which are integrally connected along a common edge and define an angle between 45° and 90° therebetween. Holes 413 extend through the first strip 411 at longitudinally and equally spaced locations to receive fasteners 433, which anchor the base member 410 to adjacent beams 77. Numerous holes 413 are provided in the first strip 411 to accommodate different spacing distances between adjacent beams 77. The fasteners 433 are preferably the same as those used to install the roof itself.

Openings 414 extend through the strips 411 and 412 at longitudinally and equally spaced locations along their common juncture, to receive tabs or hooks 424 on a respective bracket 420. Holes 415 extend through the second strip 412 at longitudinally and equally spaced locations, and cooperate with selectively aligned holes 425 through a respective bracket 420, to receive fasteners 435, which anchor the bracket 420 to the base member 410. The fasteners 435 are preferably the same as the fasteners 433. Numerous openings 414 and holes 415 are provided in the second strip 412 to accommodate different mounting locations of the bracket 420 along the base member 410.

Each of the brackets 420 is a generally T-shaped member which includes a base portion 421 having a longitudinal axis, and a distal portion 422 extending perpendicularly away from the base portion 421 (and its longitudinal axis). The tabs 424 extend away from an edge of the base portion 421 which is opposite the distal portion 422. The tabs 424 are sized and configured for insertion into the openings 414 in the base member 410, and they fold back toward the base portion 421 and cooperate therewith to retain the base member 410 therebetween. The holes 425 extend through the base portion 421 at longitudinally and equally spaced locations which correspond with the tabs 424.

The location of the distal portion 422 may be described as longitudinally or axially offset from the middle of the base portion 421, and/or as between an end hole 425 and a middle hole 425. The distal portion 422 extends perpendicularly away from the base portion 421 and terminates in an end flange 427, which is angled relative to the remainder of the distal portion 422. An elongate slot 429, extending perpendicular to the base portion 421, is provided in the end flange 427 to align with its opposing counterpart and receive a fastener.

For installation, both the desired location of the safety line 97 and the actual locations of the beams 77 are ascertained. The brackets 420 are secured to respective base members 410 by inserting the tabs 424 through respective openings 414 and securing fasteners 435 through respective holes 425 and 415. The base members 410 are mounted on the roof panels 87 in such a manner that at least two peaks are disposed therebetween. The first strips 411 rest flat against respective troughs 88, and the second strips 412 bear against respective, outwardly facing side walls 89. The fasteners 435 may be fastened through the sidewalls 89, and/or one or more pads or spacers may be disposed between the strips 412 and respective side walls 89. Subject to these constraints, the base members 410 are also positioned so the end flanges 427 on opposing brackets 420 are capable of overlapping one another. Ideally, the end flanges 427 properly align without requiring manipulation on the part of the installer. However, bending of the distal portions 422 of the brackets 420 might be required to bring the slots 429 into alignment with one another. A fastener is secured through the overlapping end flanges 427 and the anchorage 100. A safety line 97 is connected to the anchorage 100 and extends parallel to the beams 77. The brackets 420 are preferably made of sheet metal which deforms to absorb energy when subjected to a load associated with the arrest of a person's fall. In this regard, the brackets 420 are configured and arranged to twist, as well as bend, in the event of a fall. The tabs 424 are provided to absorb some of the shear force that would otherwise be exerted against the fasteners 435.

Figure 9:
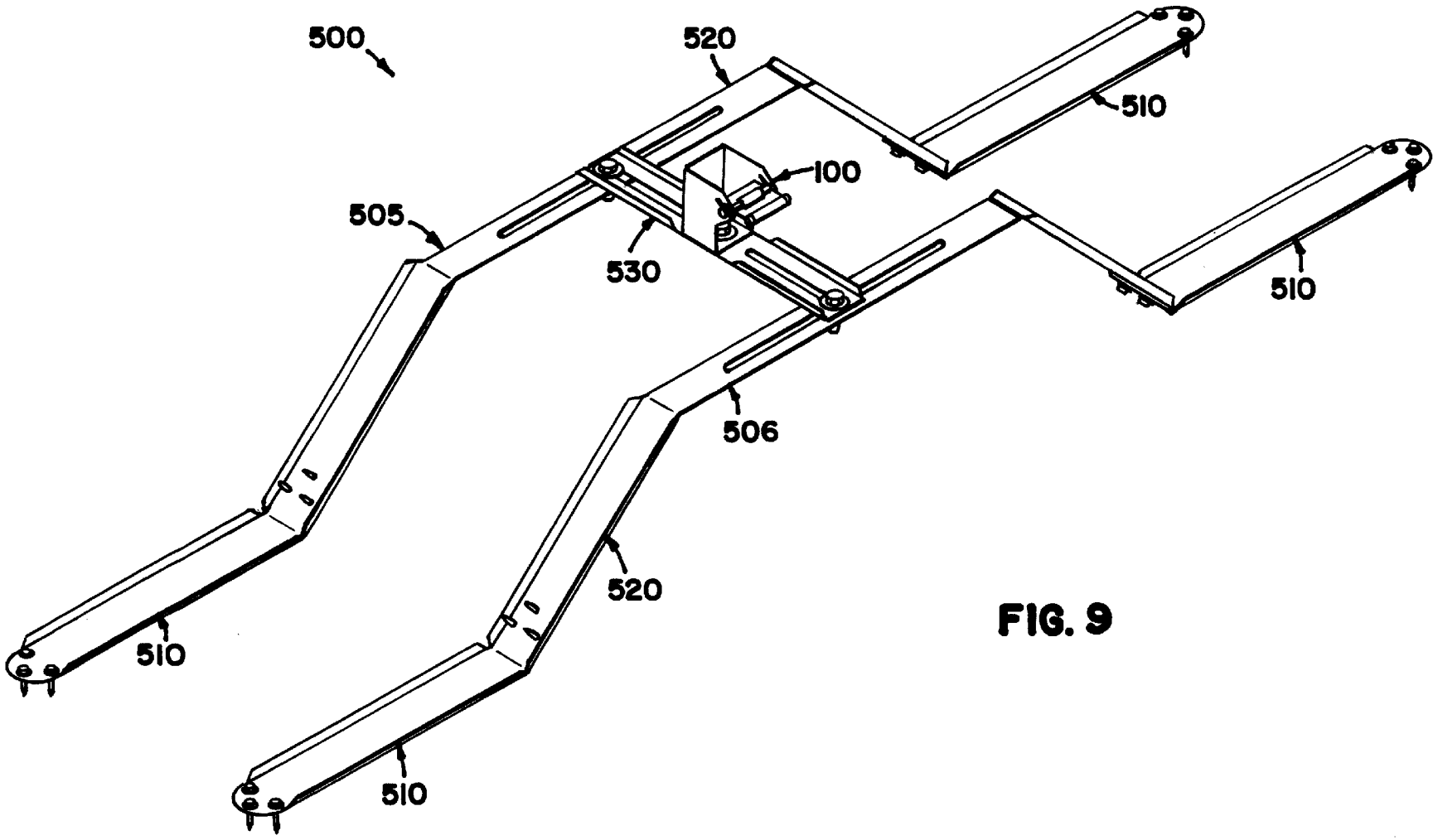
FIG. 9 is a perspective view of another roof mounting assembly constructed according to the principles of the present invention.
Figure 10:
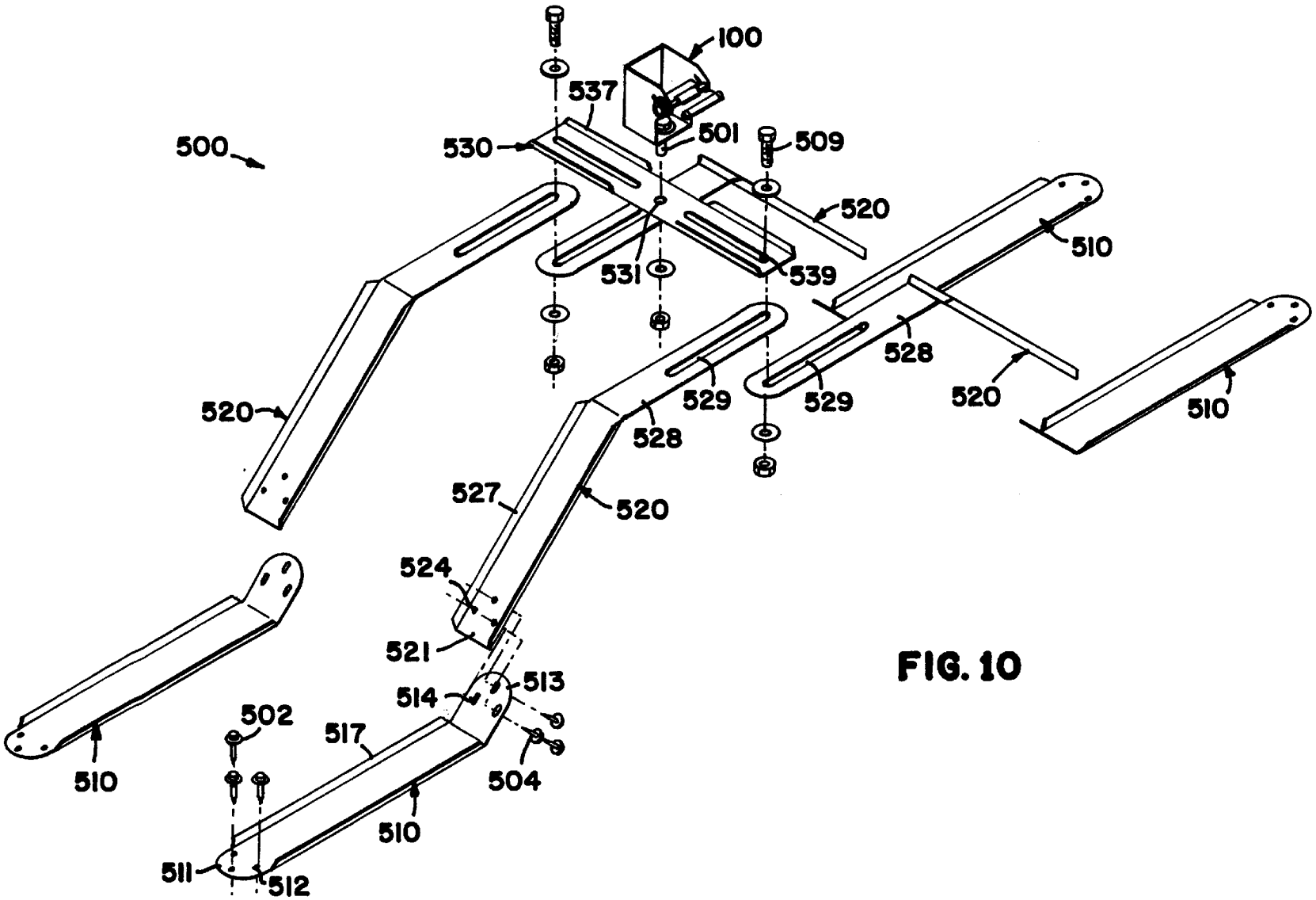
FIG. 10 is an exploded perspective view of the roof mounting assembly of FIG. 9.

FIGS. 9–10 show an alternative embodiment mounting assembly 500 for interconnection between a roof like that shown in FIG. 8, and a safety line anchor. The mounting assembly 500 generally includes first and second brackets 505 and 506 which are identical to one another. Each of the brackets 505 and 506 includes two opposite end, base members 510 and two overlapping intermediate members 520. Each of the base members 510 extends from a first end 511 to a second end 513, with relatively short side walls 517 extending along opposite side edges, between the two ends 511 and 513. The side walls 517 enhance the structural integrity of the base member 510 and provide bearing surfaces vis-a-vis the side walls 89 on the roof. Holes 512 extend through the first end 511 of each base member 510 to receive respective fasteners 502 and facilitate mounting of the assembly 500 to the roof. The second end 513 is angled relative the remainder of its base member 510, and is provided with holes 514 to receive respective fasteners 504 and facilitate mounting of a respective intermediate member 520 to its base member 510.

Each of the intermediate members 520 extends from a first end 521 to a second end 528, with relatively short side walls 527 extending along opposite side edges, between the two ends 521 and 528. The side walls 527 enhance the structural integrity of the intermediate member 520. Each first end 521 overlaps the second end of a respective base member 510, and holes 524 extend through the first end 521 of each intermediate member 520 to receive respective fasteners 504. Each second end 528 is an elongate strip having an elongate slot 529 formed therein. On each of the brackets 505 and 506, the two slots 529 overlap to accommodate a nut and bolt combination 509.

A cross-member or brace 530 is interconnected between the brackets 505 and 506. The cross-member 530 may be described as an elongate strip that is symmetrical about a plane extending perpendicularly through its geometric center. A hole 531 extends through the center of the cross-member 530 to accommodate a nut and bolt combination 501 and facilitate mounting of a safety line anchor 100. The cross-member 530 has opposite, distal portions, each of which is provided with respective, low-profile sidewalls 537 and a respective elongate slot 539. The sidewalls 537 enhance the structural integrity of the cross-member 530. Each slot 539 aligns with the overlapping slots 529 of a respective bracket 505 or 506 to accommodate a respective nut and bolt combination 509.

The foregoing disclosure sets forth only some of the possible embodiments and/or applications of the present invention. Recognizing that this disclosure is likely to lead those skilled in the art to derive additional improvements, the present invention should be limited only to the extent of the following claims.

What is claimed is:

1. A method of anchoring a safety line relative to a roof of the type having panels mounted on top of beams, comprising the steps of:

providing first and second elongate base members;

providing first and second brackets;

arranging the base members on top of the panels to span at least two adjacent beams;

fastening the base members to the beams;

positioning the brackets proximate respective base members so that distal ends of the brackets extend upward from the roof and toward one another;

fastening the brackets to respective base members; and fastening a safety line anchorage to the distal ends of the brackets.

2. The method of claim 1, wherein a single fastener is inserted through the safety line anchorage and overlapping portions of the distal ends.

3. The method of claim 1, wherein the brackets are provided with holes which are aligned with holes in respective base members prior to fastening of the brackets to respective base members.

4. The method of claim 3, wherein more holes are provided in the base members than in the brackets, and the holes in the brackets are aligned with desired holes in respective base members prior to fastening of the brackets to respective base members.

5. The method of claim 3, wherein the brackets are provided with tabs which are inserted through openings in respective base members prior to fastening of the brackets to respective base members.

6. The method of claim 5, wherein the base members are provided with more openings than the tabs on the brackets, and the tabs on the brackets are aligned with desired openings in respective base members prior to fastening of the brackets to respective base members.

7. The method of claim 1, wherein the base members are provided with holes which are aligned with respective beams prior to fastening of the base members to the beams.

8. The method of claim 1, wherein the panels have peaks and troughs which extend perpendicular to the beams, and each of the base members is arranged to rest inside a respective trough.

9. The method of claim 8, wherein each of the base members is arranged to bear against a side wall of a respective peak.

10. The method of claim 1, wherein each of the brackets is provided with a base portion and a distal portion which is off-center relative to a respective base portion.

11. A roof mounting assembly interconnected between a safety line anchorage and a roof having panels mounted on top of beams, comprising:

a first elongate base member and a second elongate base member, wherein each said base member is arranged to span at least two adjacent beams and is anchored to said beams by fasteners extending through holes in said panels; and a first bracket and a second bracket, wherein each said bracket has a first portion fastened to a respective base member, and a second portion which extends toward an opposite bracket, wherein, at least one said second portion extends upward from the roof, and said safety line anchorage is fastened to each said second portion between the first elongate base member and the second elongate base member.

12. The roof mounting assembly of claim 11, wherein each said first portion extends parallel to a respective base member, and holes in each said first portion align with holes in a respective base member when each said first portion is moved to any of several positions along a respective base member.

13. The roof mounting assembly of claim 12, wherein tabs on each said first portion align with openings in a respective base member when each said first portion is moved to any of said several positions along a respective base member.

14. The roof mounting assembly of claim 11, wherein said second portion of said first bracket overlaps said second portion of said second bracket.

15. The roof mounting assembly of claim 14, wherein a single fastener extends through said safety line anchorage and each said second portion.

16. The roof mounting assembly of claim 11, wherein each said first portion defines a longitudinal axis, and each said second portion extends perpendicular to a respective longitudinal axis.

17. The roof mounting assembly of claim 16, wherein each said first portion has a midpoint, and each said second portion is axially offset from a respective midpoint.

18. The roof mounting assembly of claim 16, wherein each said second portion intersects a respective longitudinal axis between adjacent fasteners interconnected between a respective first portion and a respective base member.

19. The roof mounting assembly of claim 16, wherein said safety line anchorage is arranged to support a safety line extending parallel to said beams, and said first bracket and said second bracket are configured and arranged to twist in response to a load applied against said safety line anchorage in a direction perpendicular to said beams and parallel to said roof.

20. The roof mounting assembly of claim 11, wherein each said second portion terminates in an end flange provided with an elongate slot which extends perpendicular to a respective base member.

* * * * *